United States Patent [19]

Hayes

[11] 4,275,580

[45] Jun. 30, 1981

[54] SUPPORT VEHICLE FOR ROLL ASSEMBLIES

[75] Inventor: Allan Hayes, Dronfield, England

[73] Assignee: Davy-Loewy Limited, Yorkshire, England

[21] Appl. No.: 34,319

[22] Filed: Apr. 30, 1979

[30] Foreign Application Priority Data

May 2, 1978 [GB] United Kingdom ..... 17259/78

[51] Int. Cl.[3] ..... B21B 31/08

[52] U.S. Cl. ..... 72/239

[58] Field of Search ..... 72/238, 239

[56] References Cited

U.S. PATENT DOCUMENTS

| | | | |
|---|---|---|---|
| 3,180,125 | 4/1965 | O'Brien | 72/239 |
| 3,221,530 | 12/1965 | Swallow et al. | 72/239 |
| 3,323,345 | 6/1967 | Lyle et al. | 72/239 |

FOREIGN PATENT DOCUMENTS

| | | | |
|---|---|---|---|
| 406245 | 2/1934 | United Kingdom | 72/239 |
| 752657 | 7/1956 | United Kingdom | 72/239 |
| 1008944 | 11/1965 | United Kingdom | 72/239 |
| 1009860 | 11/1965 | United Kingdom | 72/239 |
| 1218186 | 1/1971 | United Kingdom | 72/239 |
| 1501006 | 2/1978 | United Kingdom | 72/239 |

*Primary Examiner*—Milton S. Mehr

*Attorney, Agent, or Firm*—Daniel Patch

[57] ABSTRACT

It is desirable for a pair of horizontal roll assemblies of a rolling mill to be withdrawn from the mill simultaneously with the longitudinal axes of the rolls parallel and substantially horizontal. If material is present in the mill there can be no connection between the bearing chocks on the drive side of the mill. When the roll assemblies have been withdrawn from the mill, a support vehicle is positioned relative to the roll assemblies so that the rolls can be supported on upper and lower support surfaces provided on the vehicle. The vehicle is the displaced away from the withdrawal position of the rolls so that replacement rolls carried on a similar support vehicle can be moved to a position from which they can be inserted into the mill.

2 Claims, 1 Drawing Figure

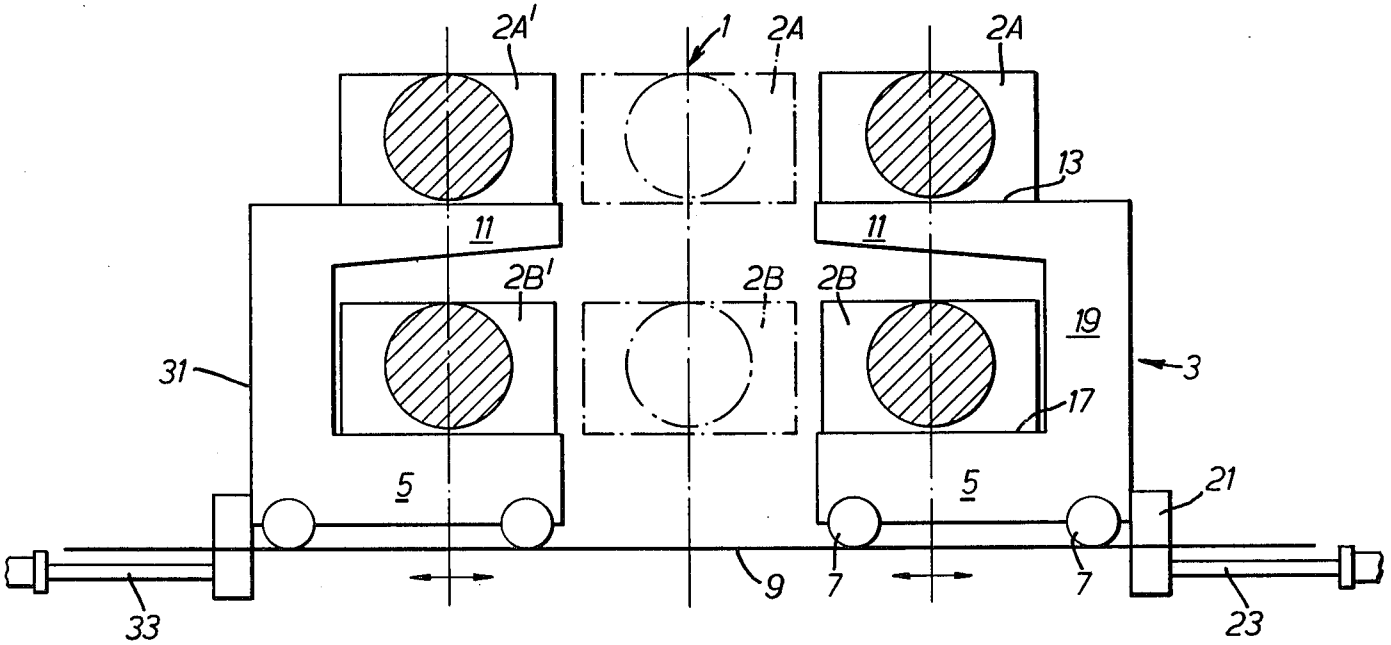
3
21
23
19
13
17
7
2A
5
11
2B
7
2A
2B
9
1
2A'
11
2B'
5
31
33

SUPPORT VEHICLE FOR ROLL ASSEMBLIES

This invention relates to a vehicle for supporting a pair of horizontal roll assemblies for a rolling mill which are spaced one above the other with the longitudinal axes of the rolls parallel and substantially horizontal.

The rolls of a mill for rolling metal strip have to be changed periodically and it is sometimes desirable to withdraw the horizontal roll assemblies comprising the rolls and their associated bearing chocks out of the mill housing simultaneously and while metal strip is still extending between the rolls. The rolls assemblies are withdrawn from the mill housing on the opposite side to the drive side of the mill and there cannot therefore be any form of connection between the bearing chocks on the rolls at the drive side of the mill. To this end it is usual to employ roll transfer means which comprise a pair of cantilevered sockets arranged one above the other at the same spacing as the roll centres. The sockets grip the adjacent ends of the rolls at the roll change side of the mill and the two roll assemblies are withdrawn in the direction of the length of the rolls simultaneously from the mill housing. Before a pair of new roll assemblies can be introduced into the mill housing by the cantilevered sockets, the old rolls have to be removed from the sockets and displaced from the withdrawal position.

It is an object of the present invention to provide a vehicle for supporting a pair of roll assemblies for a rolling mill when they are spaced one above the other with the longitudinal axes of the rolls parallel and substantially horizontal.

According to the present invention, a support vehicle for a pair of roll assemblies for a rolling mill comprises a wheeled trolley having an upper support member and a lower support member, the upper member being insertable between a pair of roll assemblies spaced apart one above the other and the longitudinal axes of the rolls parallel and substantially horizontal, and providing an upper support surface for receiving the upper of the two roll assemblies and the lower member being insertable beneath the lower of the two assemblies and providing a lower support surface for receiving the lower roll assembly.

After the pair of old roll assemblies have been withdrawn from the mill by the roll transfer means, the support vehicle is brought into a position where the upper and lower members are positioned below the upper roll assembly and the lower roll assembly respectively. The roll assemblies are then lowered together on to the upper and lower support surfaces and the sockets are removed from the ends of the rolls. The support vehicle with the roll assemblies supported on it is then moved away to a position which permits the pair of replacement rolls to be gripped by the cantilevered sockets and introduced simultaneously in the direction of their length into the mill housing.

The trolley may comprise a frame of C-section or alternatively the lower support member may comprise a base of the trolley and the upper support member projects substantially horizontal from a structure extending vertically from the base.

In order that the invention may be more readily understood it will now be described, by way of example only, with reference to the accompanying drawing which is a diagrammatic side elevation of a pair of vehicles each in accordance with the present invention.

Reference numeral 1 indicates the centre line of a rolling mill and on which the horizontal work roll assemblies 2A and 2B of the mill are arranged in vertical spaced apart relation. In order to change the work rolls, while metal strip is still present in the rolling mill, the roll assemblies are separated and the ends of the work rolls on the roll change side of the mill are gripped by means of a pair of sockets (not shown) which are carried in cantilever manner from a transfer car. After the rolls with their bearing chock assemblies have been withdrawn horizontally from the mill housing, it is necessary to support the assemblies individually. To this end a support vehicle 3 is provided. The vehicle shown on the right-hand side of the figure consists of a trolley 5 mounted on wheels 7 so as to be displaceable along a floor level track 9 extending normal to the longitudinal axes of the rolls as they are drawn from the mill housing. The trolley has an upper support member 11 which provides a substantially horizontal upper load support surface 13. The trolley also provides a lower horizontal support surface 17. The member 11 is secured in rigid relation to the trolley by a vertical structure 19 which is on the side of the trolley which is away from the centre line of the mill. A connection member 21 extends downwardly from the trolley into a slot positioned in the floor and a piston-cylinder device 23 is located beneath the floor. One part of the device is fixed and the other is connected to the connection member 21 and when the piston-cylinder device is operated the trolley is displaced along the track.

After the roll assemblies have been withdrawn from the mill housing, the support vehicle is displaced to the left in the FIGURE so that the support member 11 passes beneath the upper roll assembly 2A and the support member 15 passes below the lower roll assembly 2B. The roll assemblies are then lowered slightly so that they are supported on the support surfaces 13 and 17 respectively. The cantilevered sockets are then removed from the ends of the rolls. The support vehicle is then displaced to the right as shown in the FIGURE to a position from which the roll assemblies can be removed from the support vehicle and taken to the roll shop for roll dresssing and maintenance purposes. In the meantime, a pair of replacement roll assemblies 2A' and 2B' are mounted on the upper and lower support surfaces of a further support vehicle 31. This vehicle is mounted on the track 9 and positioned to the left of the centre line of the mill so that, as soon as the old rolls have been displaced away from the centre line on the support vehicle 3, the support vehicle 31 can be displaced into a position where the rolls are aligned with the centre line of the mill. The ends of the rolls are then gripped in the cantilevered sockets, the sockets are raised slightly to lift the assemblies off the support surfaces of the vehicle and the rolls are then introduced into the mill housing. It will be appreciated that the support vehicle 31 is reversed with respect to the vehicle 3 in that the open space between the support members 11 and 5 on the trolley 31 faces the spaces between the same members on the trolley 3.

In the arrangement shown in the FIGURE, the support members 11 and 5 together with the structure 19 form a frame of C-shape construction. As previously indicated, the support member 5 may constitute the base of the trolley with the support member 11 being separate from the base and projecting outwardly from an upstanding support structure 19. Also in the FIGURE the support vehicles are shown as being displaceable at right angles to the direction of movement of the rolls into and out of the mill. This need not be the case, since the vehicles could be displaced diagonally with respect to the direction of withdrawal of the rolls from the mill.

Furthermore, while each vehicle is shown as being displaceable by a hydraulic piston and cylinder device, it could be arranged for each vehicle to have its own drive as for example an electric motor.

Furthermore, it could be arranged for the support surfaces 13 and 5 to be provided by support members which are in the form of jacks or the like so that the surfaces can be raised and lowered slightly with respect to the trolley.

I claim:

1. A support vehicle for a pair of roll assemblies for a rolling mill, said mill having a roll changing side wherein said pair of roll assemblies are cantileverly positionable in front of said mill on said roll changing side thereof, said vehicle comprising a trolley having spaced apart upper and lower support members each providing a support surface for a different one of said pair of roll assemblies, said roll assemblies removed from or inserted into the mill in a cantilever manner one above the other in a spaced apart relation and with the longitudinal axes of the rolls parallel and substantially horizontal when arranged in a roll changing plane that passes through the axes of said roll assemblies, the respective spaced apart relation and position of said roll assemblies and said support members being such that said upper and lower support members are positioned or positionable beneath the upper and the lower roll assembly, respectively, when said roll assemblies are in said cantilever manner in said roll changing plane in front of said mill in readiness to be removed from or supported by said support members, means for moving the trolley relative to said rolling mill in a direction normal to the longitudinal axes of the rolls between a position at one side and remote from said roll changing plane and a position adjacent thereto, the construction and arrangement of said upper and lower support members being such as to form an opening on a side of said trolley in said direction normal to the longitudinal axes of said rolls to permit unrestricted access to said surfaces when said support members are positioned or are to be positioned beneath said different one of said pair of roll assemblies so that said upper and lower roll assemblies can be removed from or introduced onto said upper and lower support surfaces.

2. In a support vehicle as claimed in claim 1, wherein said means for moving the vehicle consists of wheels and a piston cylinder device one part of which is fixed and the other of which is connected to the vehicle.

* * * * *